US007045167B2

(12) United States Patent
Maytum et al.

(10) Patent No.: US 7,045,167 B2
(45) Date of Patent: May 16, 2006

(54) SOLID PARTICULATE MATERIAL APPLICATION DEVICE

(75) Inventors: James Nelson Maytum, Nunda, SD (US); Simon Charles Peter Jennings, Somerset (GB); Philip Kearne, Somerset (GB)

(73) Assignee: J&K Development LLC, Madison, SD (US)

( * ) Notice: Subject to any disclaimer, the term of this patent is extended or adjusted under 35 U.S.C. 154(b) by 15 days.

(21) Appl. No.: 10/148,568

(22) PCT Filed: Dec. 1, 2000

(86) PCT No.: PCT/GB00/04611

§ 371 (c)(1),
(2), (4) Date: Aug. 30, 2002

(87) PCT Pub. No.: WO01/40579

PCT Pub. Date: Jun. 7, 2001

(65) Prior Publication Data

US 2004/0060511 A1 Apr. 1, 2004

(30) Foreign Application Priority Data

Dec. 3, 1999 (GB) ..... 9928714.6

(51) Int. Cl.
*B05B 17/04* (2006.01)
*A01C 19/00* (2006.01)

(52) U.S. Cl. ..... 427/8; 118/678; 118/680; 118/681; 239/672; 239/677; 239/666; 239/682; 239/678

(58) Field of Classification Search ..... 118/678, 118/680, 681; 414/520, 519; 239/672, 677, 239/666, 682, 678
See application file for complete search history.

(56) References Cited

U.S. PATENT DOCUMENTS

| | | | | |
|---|---|---|---|---|
| 4,422,562 | A | 12/1983 | Rawson | |
| 5,234,128 | A | 8/1993 | Hill | |
| 5,961,040 | A * | 10/1999 | Traylor et al. | 239/1 |
| 6,012,656 | A * | 1/2000 | Anderson | 239/672 |

FOREIGN PATENT DOCUMENTS

| | | | |
|---|---|---|---|
| EP | 289685 | A | 9/1987 |
| FR | 2528085 | A | 6/1982 |
| FR | 2647131 | A | 5/1989 |
| FR | 2652835 | A | 10/1989 |

(Continued)

*Primary Examiner*—George Koch
(74) *Attorney, Agent, or Firm*—Millen, White, Zelano & Branigan

(57) ABSTRACT

A device for the application of solid particulate material to a target surface includes one or more containers for storing the solid particulate material and one or more transfer devices for transferring the solid particulate material from the containers to the target surface. Each container includes one or more gates positioned substantially at the container's outlet. Mechanisms are provided for controlling the extent to which each individual gate opens, while the device is in use; and for controlling the rate at which the transfer devices transfer the solid particulate material from the containers while the device for the application of solid particulate material to a target surface is in use. The mechanism for controlling the rate at which the transfer devices transfer the solid particulate material from the containers are coordinated with the mechanisms for controlling the extend to which each individual gate opens, and are coordinated so as to provide improved control of the overall rate of application of the solid particulate material to the target surface.

29 Claims, 3 Drawing Sheets

FOREIGN PATENT DOCUMENTS

| | | | |
|---|---|---|---|
| FR | 2656349 | A | 12/1989 |
| FR | 2659097 | A | 3/1990 |
| FR | 2752429 | A | 8/1996 |
| GB | 2021080 | A | 11/1979 |
| GB | 2163631 | A | 3/1986 |
| GB | 2163631 | B | 3/1986 |
| GB | 2229105 | A | 9/1990 |
| WO | 85/00345 | | 1/1985 |

* cited by examiner

SOLID PARTICULATE MATERIAL APPLICATION DEVICE

TECHNICAL FIELD

This invention relates to means for applying solid particulate material to a surface. In particular, the invention is concerned with means for applying aggregate to a road surface.

BACKGROUND

A known aggregate application device consists of a container, such as a hopper, for storing the aggregate, a device, such as a discharge roller, for transferring the aggregate from the container to the road surface, and means, such as a feedgate or flow blade, for controlling the amount of aggregate exiting the container. Typically, the feedgate may be adjusted to a particular setting before use so as to apply a particular depth of aggregate to the road.

Two principal means to control the aggregate application rate have evolved in the prior art:

(1) Controlling the extent to which the feedgates are opened (the speed of the discharge roller being fixed).

(2) Controlling the speed of the discharge roller (the extent to which the feedgates are opened being fixed).

Both methods have disadvantages associated therewith. Method (1) is only effective at fast ground speeds (the ground speed being the speed at which the device travels along the ground), and/or high aggregate application rates: at low aggregate application rates and slow ground speeds, the aggregate does not flow through the feedgate gap in a controllable manner. Method (2) is only effective at slow ground speeds: with a fixed opening of the gates, the discharge roller cannot transfer sufficient aggregate with the necessary degree of accuracy at faster ground speeds.

A further disadvantage associated with the known aggregate application device is that it is difficult to ensure a controlled distribution of aggregate across the full discharge width of the device, and therefore across the width of the road. In particular, the known aggregate application devices apply the same amount of aggregate across the width of the device: a problem exists with providing a greater or lesser amount of aggregate at particular sections of the road, eg to give the road a camber, or to fill in 'ruts' made by vehicle tyres on old road pavings.

U.S. Pat. No. 5,234,164 to F. K. Hill attempted to alleviate some of the problems outlined above by providing an aggregate application device with a plurality of gates associated with an expandable hopper, together with means for commonly controlling the opening and closing of the gates. Aggregate is transported via a conveyor system from a feed hopper into the expandable hopper, and is dispensed from this expandable hopper onto the road surface through the gates. However, a problem is associated with the device disclosed in this patent, in that the aggregate which it can dispense is limited to that with a substantially constant flow characteristic, and roughly even particle size distribution. Larger particles of aggregate in the material may block the outlet of the gate, which leads to little or no aggregate being applied in this location of the spread width.

UK Patent 2 163 631 to Phoenix Engineering Co. Ltd. describes apparatus for spreading flowable material comprising a main hopper and an extension hopper, both of which are provided with means for discharging the material over substantially the whole length thereof. The extension hopper is movable between a retracted position and an extended position in which it projects beyond one end of the main hopper, thereby enabling variation of the combined width of the hoppers. The device is further provided with means, such as a baffle fixed on the main hopper, for cutting off the communication between the discharging means of the extension hopper and the major part of the interior of the extension hopper over a width corresponding to the longitudinal overlap between the two. Using this apparatus, the width over which the material can be spread can be varied while the apparatus moves along. The device described in this patent is capable of achieving an application rate of up to 135 m/min (440 ft/min).

GB-A-2229105 and GB-A-2021080 disclose aggregate application devices which have a plurality of storage hoppers, each of the hoppers having a gate to adjust the rate of flow of aggregate out of said hopper. Each gate can be set independently of the others at a desired height so as to allow different application rates at different locations across the width of the device. However, the heights are predetermined before the device is used and there is no means to enable the aggregate flow to be varied during operation by variation while in use of the height of the gates.

SUMMARY

According to a first aspect of the invention, there is provided a device for the application of solid particulate material to a target surface, comprising:

one or more containers for storing the solid particulate material;

one or more transfer devices for transferring the solid particulate material from the container or containers to the target surface;

a plurality of gates, the or each container having at least one gate positioned substantially at the outlet thereof;

means for controlling the extent to which each individual gate opens, while the device is in use; and means for controlling the rate at which the transfer device or transfer devices transfers the solid particulate material from the container or containers while the device for the application of solid particulate material to a target surface is in use.

Preferably, the means for controlling the rate at which the transfer device or transfer devices transfers the solid particulate material from the container or containers, and means for controlling the extent to which each individual gate opens, are coordinated so as to provide improved control of the overall rate of application of solid particulate material to the target surface.

According to a second aspect of the invention, there is provided a device for the application of solid particulate material to a target surface, comprising:

one or more containers for storing the solid particulate material;

one or more transfer devices for transferring the solid particulate material from the container or containers to the target surface;

a plurality of gates, the or each container having at least one gate positioned substantially at the outlet thereof;

means for controlling the extent to which the gates open, while the device is in use; and means for controlling the rate at which the transfer device or transfer devices transfers the solid particulate material from the container or containers, while the device is in use;

wherein the means for controlling the rate at which the transfer device or transfer devices transfers the solid particulate material from the container or containers, and means for controlling the extent to which the gates open, are coordinated so as to provide improved control of the overall rate of application of solid particulate material to the target surface.

Typically, both controlling means may be linked to processing means, into which the user inputs information relating to the type, particle size and density of solid particulate material, and the required application rate.

In a preferred embodiment of the invention, the processing means may also be responsive to feedback signals from one or more of the following:

(a) the means for controlling the rate at which the transfer device or transfer devices transfers the solid particulate material from the container or containers;

(b) the means for controlling the extent to which the gates open;

(c) means for measuring the ground speed of the device.

Based on the information provided and, optionally, the feedback signals, the processing means may vary the rate at which the transfer device or transfer devices transfers the solid particulate material from the container or containers, and means for controlling the extent to which each the gates open, in order to maintain a substantially constant overall application rate of solid particulate material to the target surface as the ground speed of the application device varies.

Both the rate at which the transfer device or transfer devices transfer the solid particulate material from the container or containers, and the extent to which the gates open, may be varied. In preferred embodiments, the device may alternate between these different means of controlling the application rate, the point at which the means of control is changed (hereinafter the 'crossover point') being calculated by processing means based on the information provided above.

The container usually takes the form of a supply hopper. A hopper which rotates about an axle or the like so that the particulate material stored therein may flow easily out of the hopper can be envisaged. Two or more containers may be provided, preferably three. In a preferred embodiment, at least one of the containers is supplied with at least one shut-off means which can be moved from a first position where it has no effect on the flow of particulate matter from said container to a second position where it prevents flow of the particulate matter from a section of said container. A plurality of these shut-off means may be provided for any given container so that it is possible to vary the degree of flow of particulate matter from said container to a greater extent. It is possible to actuate the shut-off means while the device is in use. This is independent of the gates positioned substantially at the outlet whose function is to adjust the rate of feed of the particulate material to the transfer device.

The transfer device preferably takes the form of a moving surface, for example a discharge roller. Typically, the transfer device is located substantially at the outlet of the container or containers so that, in use, the particulate material may flow onto the upper surface of the transfer device, be carried on the upper surface of the transfer device, and then be discharged from the device onto the road surface as the device travels over that surface. Preferably, the width of the transfer device is substantially the same as that of the outlet of the container.

Preferably, as many transfer devices are provided as storage containers. Alternatively, a device with a single transfer device separated into sections, the width of each section being substantially the same as that of the outlet of the container, could be envisaged.

Preferably, a scatter plate is also provided substantially at the point where solid particulate material is discharged from the transfer device or transfer devices, in order to ensure a regular flow of solid particulate material onto the target surface.

The device is further provided with means to control the rate of transfer of solid particulate material from the container by the transfer device or transfer devices.

The device is provided with a plurality of gates, the purpose of which is to limit the depth of solid particulate material on the upper surface of the transfer device or transfer devices. The gates are positioned substantially at the outlet of the container or containers so as to control the amount of solid particulate material exiting the container or containers. Preferably, such gates take the form of blades, which lift or rotate in front of the outlet of the container or containers. A plurality of gates is provided, each of which may, in use, be controlled independently so that one or more may allow more solid particulate material to pass onto the transfer device or transfer devices than the others. This allows the application rate to vary across the width of the device. Preferably, the gates are positioned substantially above the transfer device or transfer devices.

The gates may be set in different positions relative to the transfer device so that a greater depth of solid particulate material accumulates on the transfer device or transfer devices in the width of some gates than others, in order to achieve a greater application rate to certain areas of the target surface, for example to give the road a camber or to repair ruts in the road caused by vehicle wheels.

The device may be further provided with means for controlling the extent to which each individual gate opens. For example, when the gates take the form of blades, means may be provided to raise and lower the blades in a substantially vertical plane.

Typically, such means take the form of pneumatic cylinders; each gate may be provided with a separate pneumatic cylinder so that the extent to which each individual gate is opened is controlled independently. Preferably, a pneumatic solenoid valve is opened for a fixed duration, which cause each pneumatic cylinder to be raised or lowered by a fixed distance.

The duration of each pneumatic pulse may be varied so as to vary the distance by which the gate is raised or lowered. Further, the differential pressure (ie the difference between the inlet and outlet pressure) from the cylinders may also be varied so as to control the extent to which each individual gate is opened more accurately. A smaller differential pressure leads to a smaller increment of cylinder movement from a single pneumatic pulse.

Alternatively, the means for controlling the extent to which each individual gate opens can take the form of an electrical actuator such as a DC motor.

More preferably, the means for controlling the extent to which each individual gate opens are controlled by processing means. For example, in the case where pneumatic cyclinders are provided to control the extent to which each individual gate opens, the processing means control the operation of the solenoid valve; the duration of the pneumatic pulse emitted and, therefore, the amount of air emitted into each cylinder, may therefore be controlled. The processing means may further be responsive to a feedback signal from the means for controlling the extent to which each individual gate opens.

In a preferred embodiment of the invention, the device is further provided with means to ensure the gates remain open at least to a minimum extent. This may typically be done by the use of processing means, into which the user inputs information regarding the size and type of solid particulate material to be applied, and which calculates the minimum extent to which the gate must remain opened based on this information.

Typically, the minimum extent to which the gate must remain opened is at least equivalent to the largest size of solid particulate material to be applied, in order to allow this material to pass freely under the gate and onto the surface of the transfer device. The device may be further provided with means to vary the minimum extent to which the gate must remain opened to suit varying application rates.

DESCRIPTION OF THE INVENTION

The invention will now be described by way of example with reference to the accompanying drawings, wherein.

DETAILED DESCRIPTION

Other working parts of the device, which do not form part of this invention, are described in UK Patent 2 163 631, the contents of which are incorporated herein by reference thereto.

Figure 1:
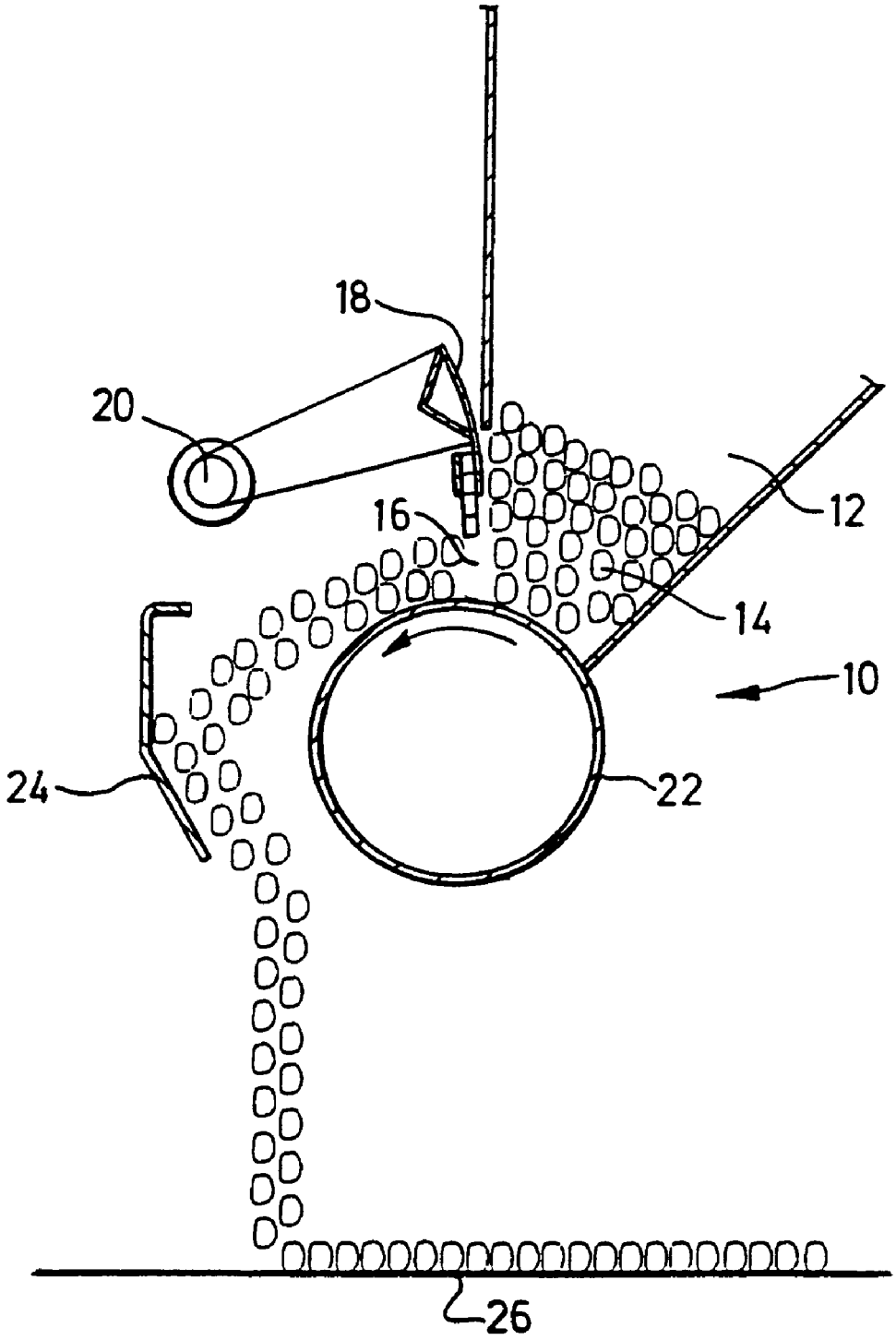
FIG. 1 depicts schematically a side view of an application device according to a preferred embodiment of the invention.

Referring first to FIG. 1, there is provided an aggregate application device 10 provided with a hopper 12 in which aggregate 14 is stored. The outlet 16 of the hopper 12 is closed by a gate 18, the position of which is rotationally controlled by means 20. The device is further provided with a discharge roller 22 and a scatter plate 24. In use, aggregate stored in the hopper 12 flows on to the upper surface of the discharge roller 22, which carries aggregate out of the hopper via outlet 16. The gate 18 partially blocks the outlet 16 and therefore limits the amount of aggregate on the surface of the discharge roller 22. Aggregate 14 which passes under the gate 18 is then discharged from the discharge roller 22 onto the road surface 26 as the aggregate application device travels over it.

The minimum extent to which the gate 18 is opened is calculated by a processing unit (not shown), in order to allow the aggregate to pass freely under the gate 18 and onto the surface of the discharge roller 22.

The scatter plate 24 directs the solid particulate material more accurately to the point of delivery on the road surface 26.

The invention may be further understood with reference to the following, non-limiting example of the device in use.

Initially the device is travelling at a slow ground speed; each gate is only opened to the minimum possible extent, so that solid particulate material may just pass freely under the gate. Under these conditions the rate of transfer of solid particulate material to the transfer device controls the application rate.

The ground speed, and the speed of the transfer device, may continue to increase until the transfer device reaches a pre-set speed. This is the 'crossover point' referred to above. At this point the extent to which each gate is opened may control the application rate. Alternatively, the extent to which each gate is opened may be used to maintain a constant application rate at faster ground speeds.

The application device according to the present invention is capable of achieving an application rate of up to 305 m/min (1000 ft/min).

Figure 2:
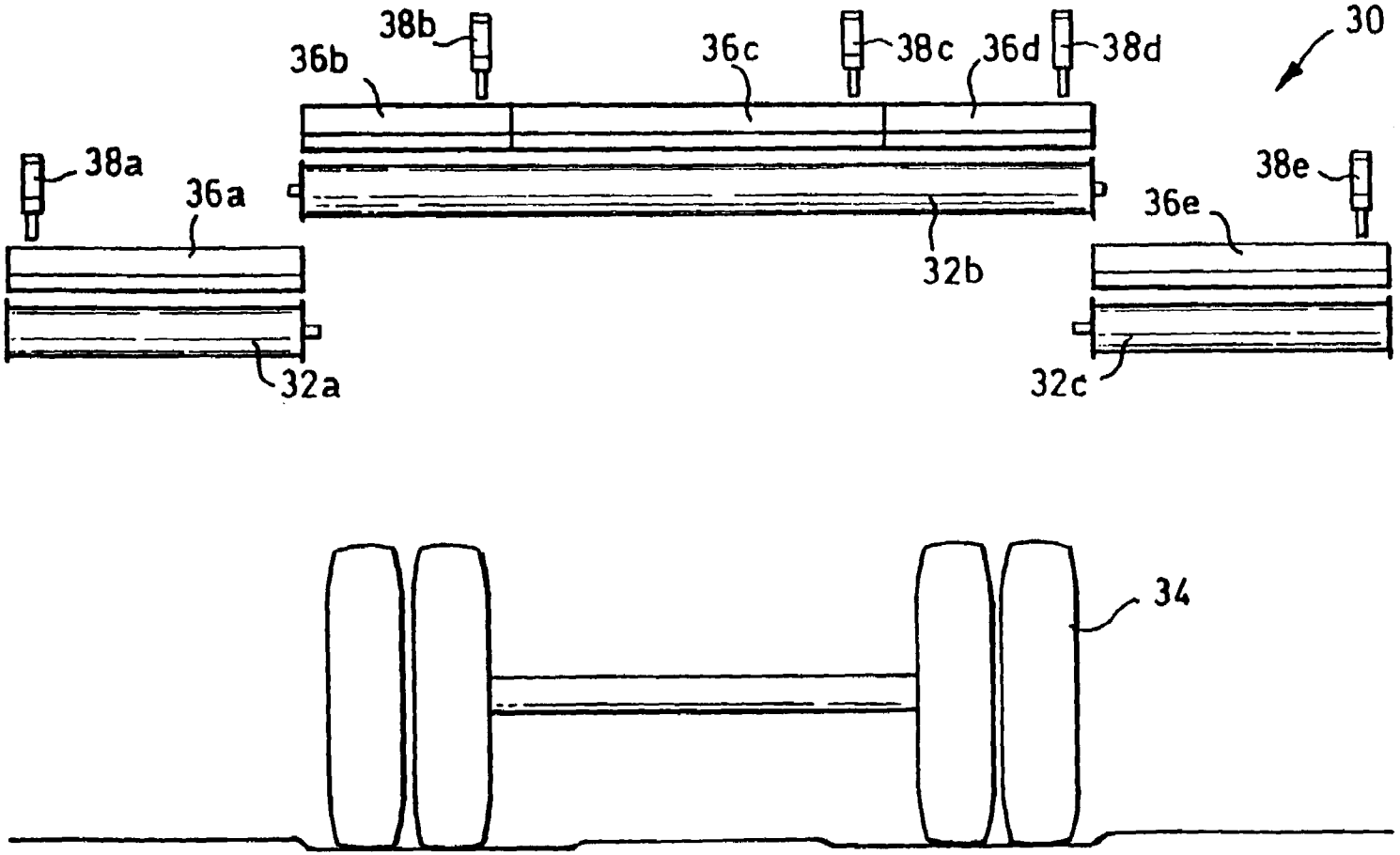
FIG. 2 depicts a front view of the device according to a preferred embodiment of the invention showing gates in different positions.

FIG. 2 illustrates schematically an application device 30 according to a preferred embodiment of the invention, provided with discharge rollers 32*a*, 32*b*, 32*c* located over road engaging wheels 34, the central discharge roller 32*b* being located at a higher position than the outside discharge rollers 32*a*, 32*c* relative to the road engaging wheels 34. The device is further provided with gates 36*a*, 36*b*, 36*c*, 36*d*, 36*e*, each gate being equipped with separate pneumatic cylinders 38*a*, 38*b*, 38*c*, 38*d*, 38*e* which allow each gate to be opened to an extent independent of the others. This allows the amount of aggregate exiting the storage hopper (not shown) to vary across the full transverse width of the device.

Pneumatic pulses from a pneumatic solenoid valve (not shown) control each pneumatic cylinder. By varying the differential pressure from the cylinders, the increment by which each pneumatic pulse moves the gate may be varied in order to control the extent to which the gates are opened more accurately.

Figure 3:
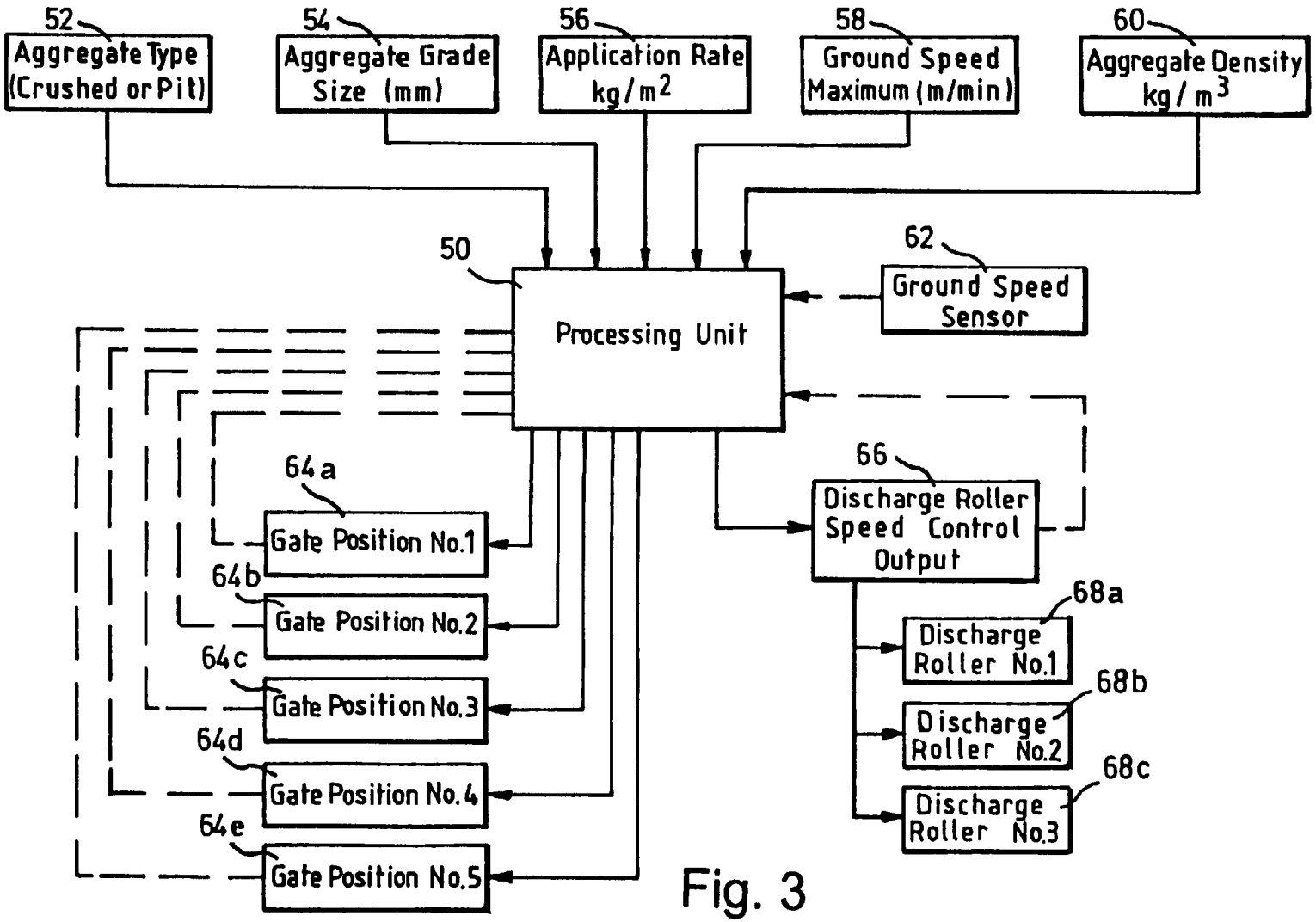
FIG. 3 is a flow diagram illustrating the method by which the processing means control the height of the gates and the speed of the discharge roller.

FIG. 3 illustrates how processing means control the device according to a preferred embodiment of the present invention. A central processing unit 50 is provided with input parameters 52, 54, 56, 58, 60, said parameters being set by the user. Processing unit 50 is also connected to means 62 for sensing the ground speed. The output of the processing unit is connected to means 64*a*, 64*b*, 64*c*, 64*d*, 64*e* for controlling the extent to which the gates are opened; optionally, said means may further provide a feedback signal to the processing unit 50.

Further to this, the output of the processing unit is connected to means 66 for controlling the speed of the discharge rollers 68*a*, 68*b*, 68*c*. Means 66 may optionally provide a feedback signal to the processing means 50.

In use, the user inputs at 52 the type of aggregate (crushed or pit) to be spread by the device, at 54 the average size of aggregate, at 56 the desired application rate, at 58 the maximum ground speed, and at 60 the density of the aggregate to be spread. This information is fed to the processing unit 50, which optionally further receives a feedback signal from the means 62 for sensing the ground speed, the means 64*a*, 64*b*, 64*c*, 64*d*, 64*e* for controlling the extent to which the gates are opened, and means 66 for controlling the speed of the discharge rollers 68*a*, 68*b*, 68*c*. Based on the information provided by the user from inputs 52, 54, 56, 58, 60 and, optionally, the feedback signals from means 62, 64, 66, the processing unit 50 calculates the extent to which the gates should be opened and transmits a signal to the means 64*a*, 64*b*, 64*c*, 64*d*, 64*e* for doing so. Further to this, the processing unit 50 calculates the necessary rate at which the discharge rollers 68*a*, 68*b*, 68*c* should remove the aggregate from the hopper and transmits a signal to the means 66 for controlling the speed of the rollers. The processing unit 50 also calculates the 'crossover constant' ($C_c$), which determines the point of crossover from discharge roller control to feedgate control.

It should be noted that the means 62 for sensing the ground speed of the device is not connected to the input parameter 58 for the maximum ground speed. Input 58 serves only as a guide and does not restrict the capability of the device to operate at lower ground speeds.

The processing unit 50 may further be programmed to control the means 64*a*, 64*b*, 64*c*, 64*d*, 64*e* for controlling the extent to which each individual gate opens. This allows the application rate to vary across the width of the device.

The speed of the discharge roller, the extent to which the gates are opened and the crossover constant may be calculated according to the formulae set out below.

Crossover Constant

Based on the information regarding the size, type and density of the aggregate inputted into the processing unit from inputs 52, 54 and 60, and empirical information from test data, the processing unit calculates the Aggregate Constant $A_c$:

$$A_c = \frac{\text{Density factor} \times \text{Type factor}}{\text{Density}}$$

The density factor is an empirical constant based on the average density of stone typically used on roads. Typically the density factor may take the value 2700 lb/yd$^3$ (1600 kg/m$^3$). The type factor is an empirical correction factor which takes into account the fact that the characteristics of aggregates vary depending on their source and treatment. Typical type factors may be 1 for crushed aggregate and 1.34 for river run aggregate.

Based on this information, input from the discharge roller control 66 and the information regarding the desired application rate inputted at 56, the processing means then calculates the 'nominal application rate' $R_n$:

$$R_n = R_a \times A_c$$

where $R_a$ is the desired application rate.

The crossover constant $C_c$ may then be calculated based on the ground speed and the above information, according to the following formula:

$$\text{Crossover constant } C_c = \frac{((A_s \times A) + B) \times S_g}{R_n}$$

wherein $A_s$ is the aggregate size, $S_g$ is the ground speed and A and B are constants.

Gate Opening Calculation

The minimum extent to which the gates open is a known proportion of the aggregate size (the typical minimum being twice the aggregate size).

The extent to which the gates open is calculated by the formula below:

$$\text{Gate Opening} = (G \times (S_g \times R_n \times (A_c/10) \times (CA_S^3 + DA_S^2 + EA_S + F))/M$$

wherein $A_c$, $A_s$, $S_g$ and $R_n$ are as defined above and C, D, E, F, G and M are constants.

Speed of Discharge Roller

Based on the inputs from means 62 for sensing the ground speed and the crossover constant $C_c$ calculated above, the processing means first calculates the speed ratio $S_p$:

$$S_p = \frac{S_g}{C_c}$$

wherein $S_g$ and $C_c$ are as defined above.

Based on this, the speed $S_r$ of the discharge roller may be calculated as set out below:

$$S_r = HS_P^3 + JS_P^2 + KS_P + L$$

wherein H, J, K and L are constants derived from test data.

The constants A to M are derived empirically by carrying out test runs of the device at known gate widths, gate openings and discharge roller speeds, and monitoring the output of aggregate from the device. Further results are obtained by varying the width of the gate, gate opening and discharge roller speed, and a curve of output against discharge roller speed is obtained. The equation of the curve may then be established by a suitable numerical method.

Typical test runs gave the values shown below:

| | |
|---|---|
| A | 40.687 |
| B | 6.751 |
| C | −5.538 |
| D | 11.9 |
| E | −8.274 |
| F | 2.721 |
| G | 15.033 |
| H | 474 |
| J | −853 |
| K | 585 |
| L | −107 |
| M | 79.613 |

The invention claimed is:

1. A method for applying solid particulate material to a target surface, the method performed in a device having one or more storage containers for storing the solid particulate material, each of the one or more storage containers comprising at least one gate positioned substantially at an outlet of the storage container, and one or more transfer mechanisms for transferring the solid particulate material from the one or more storage containers for application to the target surface, the method comprising the steps of:

controlling each of the at least one gate for controlling a discharge rate of the solid particulate material from the one or more storage containers;

controlling each of the one or more transfer mechanisms for controlling a transfer rate of the solid particulate material to the target surface according to a ground speed of the device; and coordinating the controlling of each of the at least one gate and each of the one or more transfer mechanisms to vary the rate of transfer of the solid particulate material and to vary the extent to which the gates open independently of the ground speed of the application device in a way that provides a substantially constant application rate of the solid particulate material to the target surface as the ground speed of the application device varies.

2. A method according to claim 1, wherein the step of controlling each of the at least one gate includes controlling a discharge rate of the solid particulate material from the one or more storage containers according to a ground speed of the device.

3. A device for the application of solid particulate material to a target surface, comprising:

one or more containers for storing the solid particulate material;

one or more transfer devices for transferring the solid particulate material from the container or containers to the target surface;

a plurality of gates, each container having at least one gate positioned substantially at the outlet thereof;

processing means operable to control the rate at which the transfer device or transfer devices transfers the solid particulate material from the container or containers; and a plurality of gate actuators, wherein each gate actuator is operable to control the extent to which a corresponding individual gate opens, wherein the processing means is further operable to coordinate the one or more transfer devices and the plurality of gate actuators to vary the rate of transfer of the solid particulate material and to vary the extent to which the gates open independently of the ground speed of the application device in a way that provides a substantially constant application rate of the solid particulate material to the target surface as the ground speed of the application device varies.

4. A device for the application of solid particulate material to a target surface, comprising:

one or more containers for storing the solid particulate material;

one or more transfer devices for transferring the solid particulate material from the container or containers to the target surface;

a plurality of gates, each container having at least one gate positioned substantially at the outlet thereof;

first means for controlling the extent to which each individual gate opens, the first means being operable to control the rate of application of the solid particulate material on the target surface according to a ground speed of the device for the application of the solid particulate material;

second means for controlling the rate at which the transfer device or transfer devices transfers the solid particulate material from the container or containers; and processing means operable to coordinate the first and second means to vary the rate of transfer of the solid particulate material and to vary the extent to which the gates open independently of the ground speed of the application device in a way that provides a substantially constant application rate of the solid particulate material to the target surface as the ground speed of the application device varies.

5. The solid particulate material application device according to claim 4, wherein the second means and the first means are coordinated so as to provide improved control of the overall rate of application of solid particulate material to the target surface.

6. The solid particulate material application device according to claim 4, wherein the rate at which the transfer device or transfer devices transfers the solid particulate material from the container or containers, and the extent to which the gates open, are calculated by the processing means responsive to information inputted by the user, said information consisting of one or more of the following factors:

(a) the type of solid particulate material to be applied;

(b) the particle size of solid particulate material to be applied;

(c) the overall rate of application of solid particulate material to the target surface;

(d) the density of solid particulate material to be applied.

7. The solid particulate material application device according to claim 4, wherein the processing means is further responsive to a feedback signal from means for sensing the ground speed of the application device.

8. The solid particulate material application device according to claim 4, wherein the processing means is further responsive to a feedback signal from the second means.

9. The solid particulate material application device according to claim 4, wherein the processing means is further responsive to a feedback signal from the first means.

10. The solid particulate material application device according to claim 4, wherein the transfer device takes the form of a moving surface.

11. The solid particulate material application device according to claim 4, wherein the transfer device takes the form of a discharge roller.

12. The solid particulate material application device according to claim 4, wherein the transfer device is located substantially at the outlet of the container.

13. The solid particulate material application device according to claim 4, wherein the gates are positioned substantially above the transfer device.

14. The solid particulate material application device according to claim 4, wherein the gates take the form of blades, which are liftable in front of the outlet of the container.

15. The solid particulate material application device according to claim 4, wherein the gates take the form of blades, which are rotatable in front of the outlet of the container.

16. The solid particulate material application device according to claim 4, wherein the gates may be set in different positions relative to the transfer device.

17. The solid particulate material application device according to claim 4, wherein the first means take the form of pneumatic cylinders.

18. The solid particulate material application device according to claim 17, wherein the pneumatic cylinders are controlled by pneumatic pulses from a solenoid valve.

19. The solid particulate material application device according to claim 18, wherein the duration of the pneumatic pulses may be varied.

20. The solid particulate material application device according to claim 18, wherein the difference in pressure between the input and output of the cylinders may be varied.

21. The solid particulate material application device according to claim 4, wherein the processing means is responsive to a feedback signal from the first means.

22. The solid particulate material application device according to claim 4, further provided with means to ensure the gates remain open to a minimum extent.

23. The solid particulate material application device according to claim 22, wherein the minimum extent to which the gates remain open is calculated by the processing means.

24. The solid particulate material application device according to claim 22, wherein the minimum extent to which the gates remain opened is at least equivalent to the largest size of solid particulate material to be applied.

25. The solid particulate material application device according to claim 4, wherein the solid particulate material is aggregate.

26. A device for the application of solid particulate material to a target surface, comprising:

one or more containers for storing the solid particulate material;

one or more transfer devices for transferring the solid particulate material from the container or containers to the target surface;

a plurality of gates, each container having at least one gate positioned substantially at the outlet thereof;

first means for controlling the extent to which the gates open;

second means for controlling the rate at which the transfer device or transfer devices transfers the solid particulate material from the container or containers, the second means being operable to control the rate of application of the solid particulate material on the target surface according to a ground speed of the device for the application of the solid particulate material; and processing means operable to coordinate the first and second means to vary the rate of transfer of the solid particulate material and to vary the extent to which the gates open independently of the ground speed of the application device in a way that provides a substantially constant application rate of the solid particulate material to the target surface as the ground speed of the application device varies.

27. A device for the application of solid particulate material to a target surface, comprising:

one or more containers for storing the solid particulate material;

one or more transfer devices for transferring the solid particulate material from the container or containers to the target surface;

a plurality of gates, each container having at least one gate positioned substantially at the outlet thereof;

first means for controlling the extent to which each individual gate opens;

second means for controlling the rate at which the transfer device or transfer devices transfers the solid particulate material from the container or containers, the second means being operable to control the rate of application of the solid particulate material on the target surface according to a ground speed of the device for the application of the solid particulate material; and processing means operable to coordinate the first and second means to vary the rate of transfer of the solid particulate material and to vary the extent to which the gates open independently of the ground speed of the application device in a way that provides a substantially constant application rate of the solid particulate material to the target surface as the ground speed of the application device varies.

28. A device for the application of solid particulate material to a target surface, comprising:

one or more containers for storing the solid particulate material;

one or more transfer devices for transferring the solid particulate material from the container or containers to the target surface;

a plurality of gates, each container having at least one gate positioned substantially at the outlet thereof;

first means for controlling the extent to which the gates open, the first means being operable to control the rate of application of the solid particulate material on the target surface according to a ground speed of the device for the application of the solid particulate material;

second means for controlling the rate at which the transfer device or transfer devices transfers the solid particulate material from the container or containers; and processing means operable to coordinate the first and second means to vary the rate of transfer of the solid particulate material and to vary the extent to which the gates open independently of the ground speed of the application device in a way that provides a substantially constant application rate of the solid particulate material to the target surface as the ground speed of the application device varies.

29. A method for applying solid particulate material to a target surface, the method performed in a device having one or more storage containers for storing the solid particulate material, each of the one or more storage containers comprising at least one gate positioned substantially at an outlet of the storage container, and one or more transfer mechanisms for transferring the solid particulate material from the one or more storage containers for application to the target surface, the method comprising the steps of:

controlling each of the at least one gate for controlling a discharge rate of the solid particulate material from the one or more storage containers according to a ground speed of the device;

controlling each of the one or more transfer mechanisms for controlling a transfer rate of the solid particulate material to the target surface; and coordinating the controlling of each of the at least one gate and each of the one or more transfer mechanisms to vary the rate of transfer of the solid particulate material and to vary the extent to which the gates open independently of the ground speed of the application device in a way that provides a substantially constant application rate of the solid particulate material to the target surface as the ground speed of the application device varies.

* * * * *